United States Patent [19]

Hans

[11] 4,354,640

[45] Oct. 19, 1982

[54] ELECTROMAGNETICALLY ACTUATABLE VALVE

[75] Inventor: Waldemar Hans, Bamberg, Fed. Rep. of Germany

[73] Assignee: Robert Bosch GmbH, Stuttgart, Fed. Rep. of Germany

[21] Appl. No.: 187,129

[22] Filed: Sep. 15, 1980

[30] Foreign Application Priority Data

Oct. 4, 1979 [DE] Fed. Rep. of Germany ..... 2940239

[51] Int. Cl.[3] ..... B05B 1/30; B05B 1/32

[52] U.S. Cl. ..... 239/585; 239/533.9

[58] Field of Search ..... 239/585, 583, 584, 533, 239/533.1, 533.3, 533.6, 533.9; 251/129, 139, 141

[56] References Cited

U.S. PATENT DOCUMENTS 3,432,106 3/1969 Townsley et al. ..... 239/585

3,738,578 6/1973 Farrell ..... 239/585

4,156,506 5/1979 Locke et al. ..... 239/585

*Primary Examiner*—James B. Marbert

*Attorney, Agent, or Firm*—Edwin E. Greigg

[57] ABSTRACT

An electromagnetically actuatable valve intended in particular for the injection of fuel into the intake manifold of mixture-compressing internal combustion engines with externally supplied ignition. The valve includes a flat armature which is firmly connected with a movable valve element, embodied as a ball, to cooperate with a fixed valve seat. The flat armature is supported on a first side so as to pivot about a tilt edge provided on said side and remote from the valve seat and is retained at the tilt edge on this side by the force of a spring engaging the first side of the flat armature oriented toward the valve seat. The unilateral retention of the flat armature at the tilt edge assures the unequivocal upward and downward movement of the flat armature.

8 Claims, 2 Drawing Figures

FIG.1
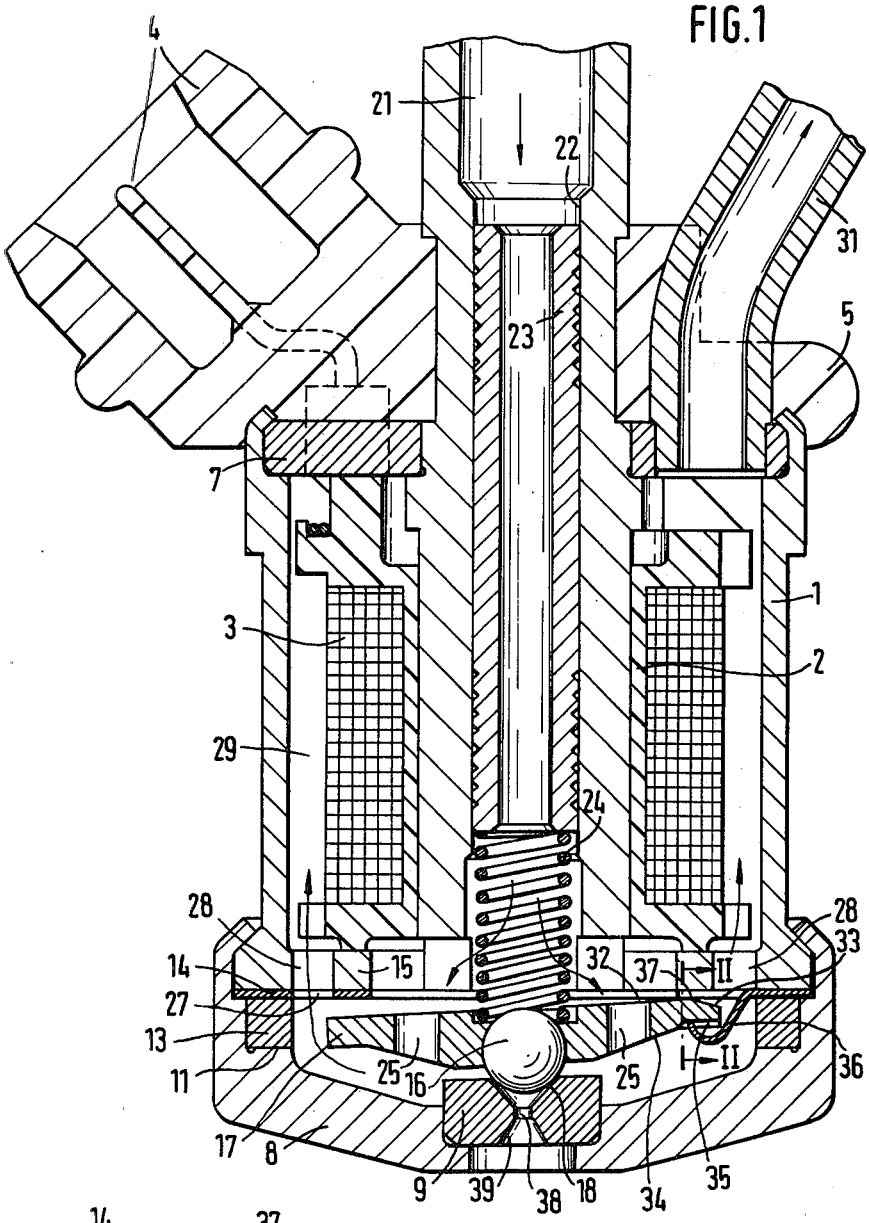
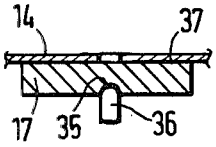
FIG.2

ELECTROMAGNETICALLY ACTUATABLE VALVE

BACKGROUND OF THE INVENTION

The invention relates generally to an electromagnetically actuatable valve, and in particular, to electromagnetically actuatable valves having flat armatures, connected to movable valves associated with fixed valve seats.

Similar electromagnetically actuable valves are well known, such as one in which the flat armature is guided by means of a diaphragm clamped for retention to the housing at its circumference. This type of suspension of the flat armature via a diaphragm does entail a disadvantage, however, because there is the danger that the flat armature will execute uncontrolled fluttering movements before, during and after actuation.

OBJECT AND SUMMARY OF THE INVENTION

It is an object of the invention to disclose an electromagnetically actuatable valve having the advantage over known electromagnetic valves that the flat armature is unequivocally controlled so as to eliminate flutter during upward (attracting) or downward movement. The result is an improvement in the characteristic curve of the valve.

It is a further object of the invention to provide an electromagnetic valve whose valve element includes a flat armature positively connected to a ball element.

It is a still further object of the invention to provide a spring force which holds the flat armature, with the tilt edge, parallel to the valve axis, on a first side of the armature.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 1 shows a fuel injection valve in cross-sectional view; and

FIG. 2 shows a sectional view along the line II—II of FIG. 1.

DESCRIPTION OF THE PREFERRED EMBODIMENT

The fuel injection valve shown in FIG. 1, intended for a fuel injection system, serves to inject fuel, especially at low pressure, into the intake manifold of mixture-compressing internal combustion engines with externally supplied ignition. A magnetic coil 3 is disposed on a coil carrier 2 in a valve housing 1. The magnetic coil 3 is supplied with electric current via an electric plug connector 4, which is embedded in a plastic ring 5 placed axially upon the valve housing 1. A cover plate 7 is inserted into the end of the valve housing 1 oriented toward the electric plug connector 4 and seals the valve housing at this end as a result of flanging and welding or soldering. On the end of the fuel injection valve remote from the electric plug connector 4, a nozzle carrier 8 is flanged in a sealing fashion to the valve housing 1 and has a nozzle body 9 disposed within it.

A stroke ring 13 rests on a step 11 in the interior of the nozzle carrier 8 and a remnant air disc 14 rests, in turn, on the stroke ring 13. As a result of the pressure force caused by the flanging of the nozzle carrier 8 on the valve housing 1, the remnant air disc 14 is held in place. The remnant air disc 14, made of non-magnetic material, extends at least in part radially over a base 15 of the valve housing 1 remote from the electric plug connector 4 and prevents magnetic adherence of the flat armature 17 to the base 15. A ball 16 acts as the movable valve element, being firmly connected to the flat armature 17 and cooperating with a conically shaped, fixed valve seat 18 in the nozzle body 9. The supply of fuel, for instance gasoline, is effected via a central fuel inlet nozzle 21, which acts simultaneously as a core and as the element on which the coil carrier 2 is disposed. A tube insert 23 is inserted in the inlet bore 22 of the fuel inlet nozzle 21. A spring means 24 is supported on one end on the tube insert 23 and on the other end on the flat armature 17. In the non-excited state of the magnetic element 3, 15, the spring means 24 presses the ball 16 against the valve seat 18 of the nozzle body 9, closing the valve. The fuel flowing via the fuel inlet nozzle 21 into the fuel injection valve proceeds through apertures 25 in the flat armature 17 to the actual valve, made up of the valve seat 18 and the ball 16; from there, the fuel can flow past the outer circumference of the flat armature 17 via recesses 27 in the remnant air disc 14 and via openings 28 in the base 15 of the valve housing 1 into a coil chamber 29 formed between the magnetic coil 3 and the valve housing 1. The coil chamber 29 communicates via a fuel discharge nozzle 31 with a fuel return line, not shown.

The preferably circularly embodied flat armature 17 has a circular sectional area 33 on a first side 32 remote from the valve seat 18. This area 33 is bevelled toward a second side 34 oriented toward the valve seat 18. A zone having a radially extending groove 35 is provided on the second side 34 of the flat armature 17 oriented toward the valve seat 18, the center line of which groove 35 is preferably in the same plane as the center line of the circular sectional area 33. The further spring means comprises a tongue 36 engaging the flat armature 17 in the groove 35, which tongue is preferably formed from the remnant air disc 14. The tongue 36 presses the flat armature 17, at an edge 37 raised from the circular sectional area 33, against the remnant air disc 14 (see FIG. 2 as well). The point of engagement of the tongue 36 on the flat armature 17 should be as much as possible in one plane with the edge 37, and parallel to the valve axis, in order to prevent the exertion of a supplementary force on the part of the tongue 36 in the opening direction of the flat armature 17. The tongue 36 does not necessarily have to be formed out of the remnant air disc 14; instead, it could be embodied as a separate sheet-metal spring, attached to the housing. As a result of the unilateral fixation of the flat armature 17 with the edge 37 resting on the remnant air disc 14, which is effected by means of the tongue 36, it is assured that the flat armature 17 can perform only a pivotal movement, solely about the edge 37. Any lateral fluttering movement of the flat armature 17 is prevented.

In the excited state, the flat armature 17 is attracted by the magnetic coil 3 and the ball 16 opens a flow-through cross section opposite the valve seat 18, by way of which fuel can flow into a throttling nozzle bore 38, which is provided in the nozzle bore 9 and meters the fuel, and can be ejected by way of an adjacent ejection port 39, which diverges from the nozzle bore in conical fashion.

The embodiment of the fuel injection valve also makes it possible for fuel continuously flowing via the fuel inlet nozzle 21 from a fuel supply line (not shown) to be carried past the valve seat 18 and around the magnetic coil 3, flowing back out via the fuel discharge nozzle 31 into a fuel return line. Thus, firstly, any vapor bubbles which may form as a result of heating are carried along into the fuel return flow line, and, secondly, a continuous cooling of the fuel injection valve by the flow fuel is assured. The particular fixation of the flat armature 17 provided in the invention results in very satisfactory dynamic behavior of the valve and in great precision in fuel metering.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In an electromagnetically actuatable fuel injection valve for fuel injection systems of internal combustion engines having a valve axis and including a housing, a flat armature firmly connected to a movable valve element arranged to cooperate with a fixed valve seat, first spring means for exerting a force in an axial direction on said armature, and electromagnetic means for exerting a force in an opposite direction on said armature when electrically energized, the improvement which comprises:

said flat armature, which further includes oppositely disposed first and second surfaces, said first surface including an edge remote from said valve seat; and a further spring means for exerting a force on said second surface of said armature in the direction of said first surface edge, to hold said edge in contact with an adjacent fixed surface, wherein said armature is pivotable about said edge in response to the forces exerted on the armature by said first spring means and said electromagnetic means, to open or close the valve.

2. A valve as defined by claim 1, further characterized in that said first surface includes a first area and a second area which is remote from said valve seat and is bevelled toward said second surface, wherein said first surface edge about which said armature is pivotable is formed by the intersection of said first and second areas of the first surface.

3. A valve as defined by claim 1, further characterized in that said edge on said first surface and the point of engagement of the further spring means and the armature extend in one plane parallel to the valve axis.

4. A valve as defined by claim 2, further characterized in that said edge on said first surface and the point of engagement of the further spring means and the armature extend in one plane parallel to the valve axis.

5. A valve as defined by claim 1, further characterized in that said further spring means comprises a tongue attached to the housing.

6. A valve as defined by claim 5, further characterized in that said tongue is formed from a remnant air disc of non-magnetic material, said air disc being disposed between the flat armature and the magnetic element.

7. A valve as defined by claim 6, further characterized in that said tongue engages a radially extending groove on the second surface of the flat armature.

8. A valve as defined by claim 1, further characterized in that said movable valve element comprises a ball firmly connected to said flat armature.

* * * * *